United States Patent [19]

Hammarberg

[11] Patent Number: 4,738,204

[45] Date of Patent: Apr. 19, 1988

[54] PALLET WITH SPACERS

[76] Inventor: Lars Hammarberg, Avant-Poste 3, CH-1005 Lausanne, Switzerland

[21] Appl. No.: 898,747

[22] Filed: Aug. 18, 1986

Related U.S. Application Data

[63] Continuation-in-part of Ser. No. 551,979, filed as PCT/SE82/00310, Oct. 1, 1982, published as WO83/02931, Sep. 1, 1983, abandoned.

[30] Foreign Application Priority Data

Feb. 26, 1982 [SE] Sweden ..... 8201232

[51] Int. Cl.[4] ..... B65D 19/26

[52] U.S. Cl. ..... 108/51.1; 108/52.1; 108/56.3; 206/599

[58] Field of Search ..... 108/51.1, 56.1, 56.3, 108/57.1, 52.1, 54.1, 53.1; 206/599, 600

[56] References Cited

U.S. PATENT DOCUMENTS

| | | | |
|---|---|---|---|
| 2,542,129 | 2/1951 | Fletcher | 108/52.1 X |
| 2,597,411 | 5/1952 | Vankrimpen | 108/57.1 |
| 2,621,006 | 12/1952 | Norrefeldt et al. | 108/51.1 |
| 2,942,824 | 6/1960 | Lyman | 108/57.1 |
| 3,472,182 | 10/1969 | Eklund | 108/51.1 |
| 3,641,948 | 2/1972 | Brown . | |
| 3,835,791 | 9/1974 | Brown . | |
| 4,051,786 | 10/1977 | Nordgren | 108/56.3 X |
| 4,060,037 | 11/1977 | Gustafsson | 108/51.1 |
| 4,292,900 | 10/1981 | Bula | 108/57.1 X |
| 4,384,531 | 5/1983 | Spurgeon | 108/51.1 |
| 4,475,703 | 10/1984 | Nordgren | 108/56.1 X |

FOREIGN PATENT DOCUMENTS

| | | | |
|---|---|---|---|
| 567438 | 5/1958 | Belgium | 108/51.1 |
| 2326607 | 4/1977 | France | 108/56.1 |
| 184548 | 7/1963 | Sweden | 108/51.1 |
| 203113 | 3/1966 | Sweden . | |
| 402442 | 7/1978 | Sweden . | |
| 786409 | 11/1957 | United Kingdom | 108/51.1 |
| 630130 | 11/1978 | U.S.S.R. | 108/56.3 |

*Primary Examiner*—Peter A. Aschenbrenner
*Assistant Examiner*—Thomas A. Rendos
*Attorney, Agent, or Firm*—Ostrolenk, Faber, Gerb & Soffen

[57] ABSTRACT

The pallet of the invention includes a load deck supported on pallet feet or spacers. The spacers of the invention are metal sleeves, each with a serrated upper edge, the entire length of which is pressed into the wooden load deck to substantially the entire depth of the serrations. The serrations may be alternately set in opposite directions, and function to prevent turning and lateral movements of the spacers in relation to the load deck. The spacers are each retained against the load deck by at least two fastening means, which may be shaped like nails. The lower edge of each spacer may also be serrated for connecting to a skid to which the fastening means are also attached.

4 Claims, 4 Drawing Sheets

FIG.14
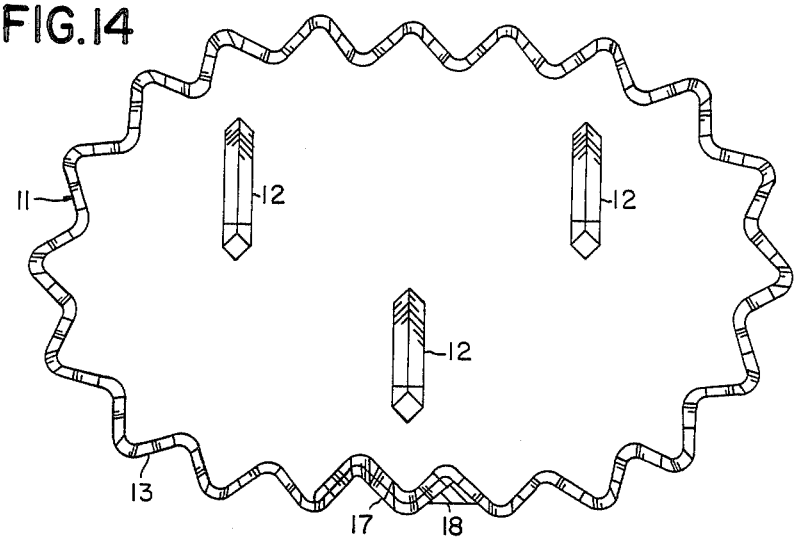
FIG.15
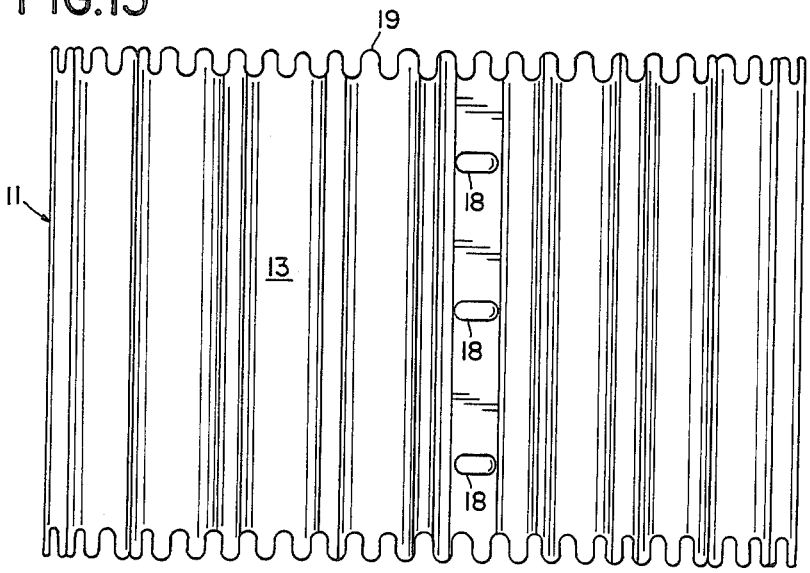
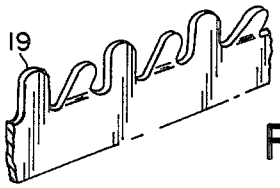
FIG.13

PALLET WITH SPACERS

This application is a continuation-in-part of application Ser. No. 06/551,979 filed as a PCT SE82/00310, Oct. 1, 1982, published as WO83/02931, Sep. 1, 1983, now abandoned.

BACKGROUND OF THE INVENTION

The present invention relates to a method of manufacturing pallets consisting of a load deck and feet or stringers and blocks supporting the deck, ads well as pallets manufactured according to said method.

Since the beginning of 1940 the importance of the pallet in materials handling has steadly increased. At present the consumption in the western world is about one pallet per capita per year. It is predicted that this will be doubled within a decade. In the USA, special rapidly growing forests have therefore been planted to ensure sufficient lumber for pallets. In Western Europe the consumption is about 300 million pallets per year, or about 15 million $m^3$ of lumber, i.e. more than the total Swedish production of sawn timber products. On an average about 20% of the world's sawn timber production is used for pallets. Factory inspection laws and the like in some countries, requiring that manual handling of goods be restricted to items weighing less than 40 kg, about increase the use of palleted goods during transport. Lumber costs about $0.12 per kg, plastics $0.72 per kg, steel $0.24–$0.60 per kg and, although in a great steel producing country like Japan, a pallet can cost about $14.40, 90% of the pallets in Japan are still made from wood, which shows that wood is a very competitive material. It can therefore be expected that other materials will only replace wood in certain parts of a pallet. The European Pallet Union, in which the railroad companies in eighteen Western European countries are members, calls for a pallet structure according to a standard which has the code SIS 842007 in Sweden. This standard has previously specified materials exhaustively.

In later years, particularly at the Swedish Packing and Wrapping Research Institution, attempts have been made to change the standard to a functional standard, under which material other than wood may be used in building a pallet, providing that the material adequately fulfills the functional requirements of the standard in all respects.

SUMMARY OF THE INVENTION

The present invention has been conceived against the background of the aforesaid condtions. In addition there is a need for an efficient method of producing a pallet, which meets all of the applicable standards, but has a greater life, and preferably a lower manufacturing cost, than the standard pallets used today. What distinguishes the invention, inter alia, is the new method of manufacturing, which eliminates in principle the time-consuming and costly nailing methods used previously for conventional wooden pallets. Another new feature is the pallet feet or spacers used in the manufacturing method. The inventive pallet foot or spacer comprises a metal sleeve, one end of which engages the load deck of the pallet. The sleeve end can be pressed into the deck material along substantially the entire periphery of the sleeve. The resulting pallet, which is manufactured mainly from wood, agrees in all essentials with internationally used pallet types and meets the applicable standards. The pallet has a foot or spacer of metal, however, resutling in a pallet which is substantially stronger and somewhat surprisingly, also lighter and cheapter than previous pallets.

BRIEF DESCRIPTION OF THE DRAWINGS

The invention will now be described in detail with reference to the accompanying drawings in which:

FIG. 13 is a partial perspective view of the serration formation of the foot or spacer shown in FIG. 15, where the serrations have rounded tips.

FIG. 14 is a plan view showing placement of the fastening means, formed as nail elements, the overlap of the ends of the spacer, and the weld applied to couple overlapping ends of the spacer.

FIG. 15 is a side view of the foot or spacer showing the serrations having rounded tips and the welds applied to couple the overlapping ends of the spacer.

DETAILED DESCRIPTION OF THE PREFERRED EMBODIMENTS

The pallet illustrated in FIGS. 1–4 is a presently generally available standard pallet of the European exchange pallet type, the so-called EUR pallet. This standard pallet is manufactured from wood, i.e. skids or stringers 1, 3, deck boards 2, 4, 5, 6 as well as pallet feet or spacers 7, 8 are manufactured from solid wood. These parts are joined together by manual or automatic nailing 9, 10 using known nailing techniques. To illustrate the value of the present invention, it may be mentioned that the amount of timber used for the spacers in this type of pallet is considerable, i.e. about one quarter of the entire timber requirement for the pallet. From the strength aspect, the timber spacers are also the "weakest link" in the traditional pallet structure.

Figure 1:
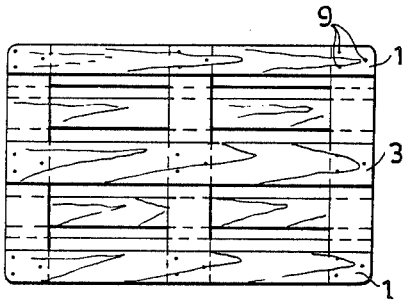
Fig. 1 PRIOR ART
FIGS. 1–4 are plan and cross-sectional views of a standard pallet of the type called "EUR pallet" which is the European type of exchangeable pallet.
Figure 2:
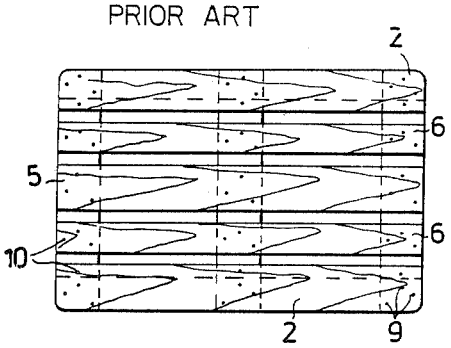
Fig. 2 PRIOR ART
Figure 3:
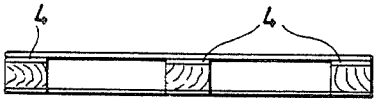
Fig. 3 PRIOR ART
Figure 4:
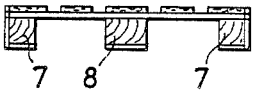
Fig. 4 PRIOR ART
Figure 5:
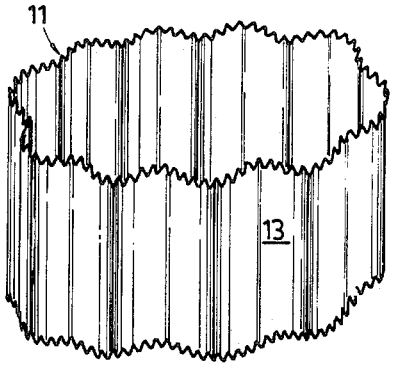
FIG. 5 is a side view of a pallet foot or spacer formed in accordance with the invention.

Manufacturing the spacers according to the embodiment illustrated in FIG. 5 achieves a final result which is better in many respects. In this case the spacer 11 comprises a metal sleeve manufactured from a metal strip folded and jointed to the desired shape. To obtain an attachment of the spacer 11 to the pallet deck 2, 4, 5, 6 and stringers 1, 3 that is as stable as possible, it is advantageous to form the sleeve edges which a serrated configuration. This implementation of the sleeve edges facilitates their primary penetration into the wood material 2, 4, 5, 6 or the deck and also into the wood material of the optional associated stringers, 1, 3. When the serrations have penetrated to their entire depth, penetration will cease unless a much larger force is used. The serrated edge on the sleeve of spacer 11 is very advantageous in several respects. For example, the desired penetration of the sleeve edge into the wood material is facilitated, and a well defined point where penetration ceases is obtained. The penetration would otherwise destroy the pallet if it were to become heavily loaded in its use as a load carrier.

Figure 8:
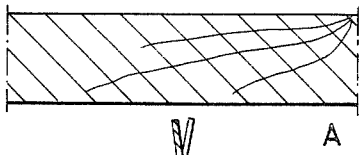
FIGS. 8–10 are partial sections showing in sequence how the set teeth or serrations on the foot or spacer penetrate into the deck material.
Figure 9:
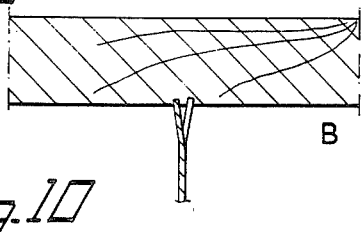
Figure 10:
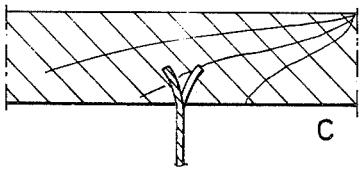
Figure 6:
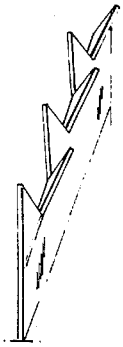
FIG. 6 is a partial perspective view of the serration formation of the foot or spacer shown in FIG. 5.

The spacer 11 of FIG. 5 may be further improved by providing the serrations with a given set, so that the individual teeth slope alternatingly away from either side of the vertical plane of the sleeve as shown in FIG. 6. The result of the set is to cause the teeth, when they are pressed into the wood material, to penetrate it at an angle, or rather in a somewhat curved path in relation to the plane of the deck, as shown in FIGS. 8–10. Two important technical effects of this are that spacer 11 is locked directly in the wood material, and also that the stopping effect when the serrations bottom is increased, i.e. the risk of further undesirable penetration into the wood material under large load stresses is kept to a minimum.

Figure 11:
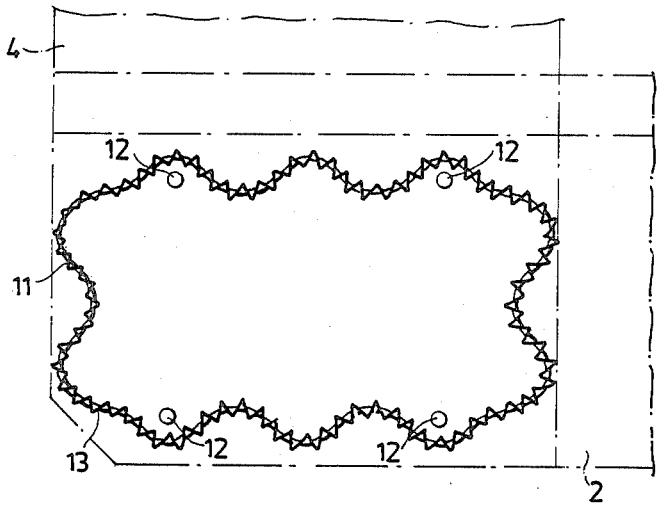
FIG. 11 is a plan view showing the placement of the fastening means, formed as nail elements, in an assembled pallet foot or spacer in accordance with the invention.

In the embodiment illustrated in FIG. 5, the shape of the sleeve has been selected such that an increased stability is obtained in the side walls thereof. The fastening means 12 formed as nail elements, are arranged inside the sleeve of spacer 11, as will be seen from FIG. 11, to provide protection in respect to outside mechanical damage, e.g. knocks from fork truck tines etc. In this example, the sleeve wall 13 has been made as a corrugated metal strip to distribute the stresses from the load on the deck over as large an area of wood material thereof as possible. As will be seen from FIGS. 11 and 12, after all nine spacers in the pallet have been joined with the aid of fastening means 12 to the other pallet parts, the result will be a unitary assembly wherein the parts are kept together with great stability. This stability is obtained inter alia with the clinching method used, the ends 15 of the fastening means being bent down and buried in the respective outer surface. A further stabilizing effect is obtained, particularly with regard to diagonal stability of the pallet, by the sleeve edge 16 itself being pressed into the sides of the boards facing towards the sleeve of spacer 11 during pressing together of the deck and skid boards. It has been found that the increased twisting stiffness obtained in the respective spacer joint drastically increases the pallet stability and strength and thereby increases its life as well.

Figure 12:
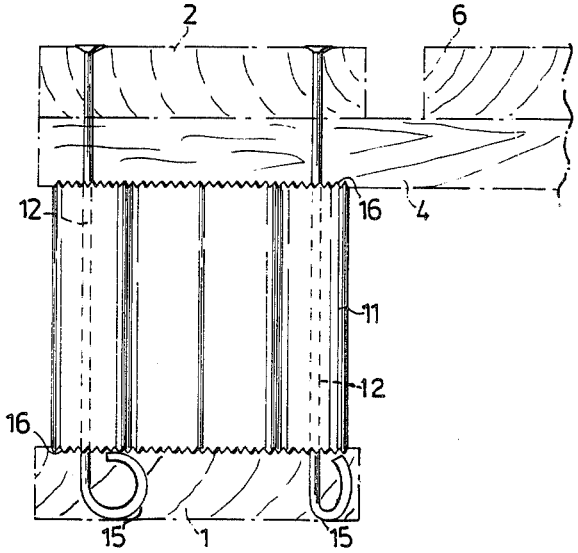
FIG. 12 is a side view of the foot or spacer shown in FIG. 11, with the wooden portions indicated by chain-dotted lines.

The embodiment illustrated in FIGS. 5–12 of the pallet feet or spacers is only an example of a suitable implementation of the invention. This embodiment may of course be varied in many different ways in respect of the shape of the sleeve and the type of fastening means used. The sleeve can also be manufactured by cutting off metal pipes, tubes or profiles to obtain other configurations of the spacer. The downward bending and driving-in of the tip of the nail-like fastening means in the respective board, as illustrated in FIG. 12, can of course be replaced by clinching or by some form of riveting, possibly in combination with a suitable washer. The clinching or like operation can of course be completely dispensed with, although such a fastening technique undoubtedly substantially increases the ability of the joint to remain rigid and tight.

The serrations on the metal sleeve of spacer 11 are shown in FIG. 6, including the result of setting the teeth, and FIGS. 8–10 illustrate how these teeth are pressed into the deck 2, 4, 5, 6 in alternate directions during the compression operation.

In an alternative form of the invention, shown in FIGS. 13 and 15, the serrations are formed with rounded tips 19. As shown in FIG. 14, the ends of the corrugated metal strip are overlapped and, although not necessary, may be provided with welds 18 for added strength. As further shown in FIG. 14, the spacer is perferably oval-shaped, although a circular shape is also possible. At least two nails 12 are bent and driven in as shown in FIG. 12 to fasten the deck, spacer, and skid together. If three nails are used, they may be disposed in a triangular arrangement as shown in FIG. 14.

Figure 7:
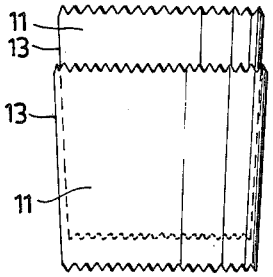
FIG. 7 is a side view of a conical embodiment of the foot or spacer of FIG. 5, also showing in outline that the feet or spacers may be nested one inside the other.

FIG. 7 shows a side view of two metal sleeves of spacer 11, when these are nested one inside the other. Making the sleeves of spacers 11 slightly conical enables, and nesting also enables them to take up much less room, which is advantageous for transport and storage.

The inventive pallet is manufactured to advantage in a continuous manufacturing line including a pressure-applying and jointing station for unitary assembly of the respective pallet parts with the aid of fastening means 12, which are possibly deformed, e.g. by bending, riveting or clinching. Distinguishing the manufacturing method in accordance with the invention is that pressing together the deck 2–6 and the foot or spacer 11 takes place in a roll nip, in which the respective parts are "mangled" together and whereby an exact dimension resulting from the compression may be obtained. This dimension can be easily regulated in the roll nip, so that it corresponds to the momentary stopping of penetration of the serrations of the sleeve of spacers 11 into the wood material which occurs when the serrations have penetrated to their entire depth.

I claim:

1. A loading pallet comprising:

a wooden deck;

a wooden skid;

a plurality of spacers connected to said deck and said skid, each spacer comprising a metal sleeve with continuous corrugations, said sleeve having a first end and a second end, said first and second ends being overlapped and welded together, said metal sleeve defining an opening therethrough and having an upper and lower edge, each of said edges having continuous serrations with rounded tips formed therein, said serrations being alternately set at opposite angles from the vertical plane defined by said sleeve the serrations of said upper edge being disposed generally toward said deck, the serrations of said lower edge being disposed generally toward said skid, the serrations of said upper and lower edge being pressed entirely into the deck and skid, respectively, for preventing turning and lateral movement of that spacer in relation to the deck and skid respectively; and, at least two nails for securing said deck, said spacers, and said skid together and for preventing vertical separation thereof, said nails extending through the deck, through the opening of the metal sleeve, and through the skid, said nails being bent at the lower side of the skid to form a hook shape within said skid.

2. A pallet as recited in claim 1, wherein said metal sleeve from said upper edge to said lower edge defines a conical shape.

3. A pallet as recited in claim 1, wherein said metal sleeve from said first end to said second end defines a circular shape.

4. A pallet as recited in claim 1, wherein said metal sleeve from said first end to said second end defines an oval shape.

* * * * *